US007250010B1

(12) United States Patent
Shindo et al.

(10) Patent No.: US 7,250,010 B1
(45) Date of Patent: Jul. 31, 2007

(54) GOLF BALL

(75) Inventors: Jun Shindo, Chichibu (JP); Atsushi Nanba, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/332,392

(22) Filed: Jan. 17, 2006

(51) Int. Cl.
*A63B 37/00* (2006.01)

(52) U.S. Cl. ..... 473/351

(58) Field of Classification Search ..... 473/351, 473/368, 367
See application file for complete search history.

(56) References Cited

U.S. PATENT DOCUMENTS

| | | | | |
|---|---|---|---|---|
| 6,180,040 | B1 | 1/2001 | Ladd et al. | |
| 6,596,801 | B2 * | 7/2003 | Higuchi et al. | 524/432 |
| 2004/0063803 | A1 | 4/2004 | Kim et al. | |
| 2004/0110906 | A1 * | 6/2004 | Fujisawa et al. | 525/331.9 |

FOREIGN PATENT DOCUMENTS

| | | | |
|---|---|---|---|
| JP | 2004-167052 | A | 6/2004 |
| JP | 2004-285322 | A | 10/2004 |
| JP | 3639534 | B2 | 1/2005 |
| JP | 2005-095493 | A | 4/2005 |

* cited by examiner

*Primary Examiner*—Raeann Trimiew
(74) *Attorney, Agent, or Firm*—Sughrue Mion, PLLC

(57) ABSTRACT

The present invention provides a golf ball composed at least in part of a material molded under heat from a rubber composition containing (a) a diene base rubber, (b) an α,β-unsaturated carboxylic acid and/or a metal salt thereof, and (c) an organic peroxide which includes an aliphatic peroxyester. The golf ball has an excellent rebound.

7 Claims, No Drawings

GOLF BALL

BACKGROUND OF THE INVENTION

The present invention relates to a golf ball having an excellent rebound.

Many studies have been conducted on the blending and preparation of rubber compositions for use in golf balls and on methods of manufacturing golf ball cores with the express purpose of conferring golf balls with an excellent rebound. See, for example, Patent Document 1: JP-A 2004-167052; Patent Document 2: JP-A 2004-285322; Patent Document 3: JP-B 3639534; and Patent Document 4: JP-A 2005-095493.

For example, JP-A 2004-167052 describes rubber compositions for golf balls which include a base rubber, a co-crosslinking agent, an organic peroxide, an inorganic filler and a processing aid, wherein the base rubber includes a polybutadiene having a cis-1,4 bond content of at least 80% and synthesized using a lanthanide series catalyst, the organic peroxide includes an organic peroxide having a 10-hour half-life temperature of 80 to 100° C., and the processing aid is a fatty acid ester, fatty acid salt or a mixture thereof; and mentions that such compositions have a good processability and enable golf balls having both an excellent rebound and an excellent durability to be obtained.

However, many golfers desire golf balls capable of achieving a longer distance, and so a need exists for the development of golf balls having an even better rebound.

SUMMARY OF THE INVENTION

It is therefore an object of the present invention to provide a golf ball having an excellent rebound.

As a result of extensive investigations, we have found that, in the production of a golf ball composed of a material molded under heat from a rubber composition which includes a diene base rubber, an α,β-unsaturated carboxylic acid and/or metal salt thereof, and an organic peroxide, the foregoing object can be achieved by including within the composition a group of organic peroxides not recognized by those skilled in the art as suitable for crosslinking rubber.

That is, rubber compositions capable of forming a crosslinked structure are commonly used in golf ball production because they confer the golf ball with a suitable hardness. Such a crosslinked structure is generally formed by the action of the α,β-unsaturated carboxylic acid and/or a metal salt thereof and the organic peroxide upon the diene base rubber. Hence, the organic peroxides selected for this purpose have until now been ones which are known to be suitable for rubber crosslinking.

Here, the organic peroxides supplied by various manufacturers for use in crosslinking rubber are all dialkyl peroxides, peroxyketal-type organic peroxides, or aromatic peroxyester-type organic peroxides (i.e., peroxyester type organic peroxides which include an aromatic ring structure within the chemical structure). Therefore, peroxyester-type organic peroxides which lack an aromatic ring structure in the chemical structure (i.e., aliphatic peroxyester-type organic peroxides) have not been investigated by those skilled in the art who are engaged in the manufacture of golf balls.

Yet, I have discovered that when a peroxide having at the site of an ester linkage an oxygen-oxygen bond capable of radical cleavage (a peroxide having the structural formula $R^a$—C(═O)—C—C—$R^b$), i.e., a peroxyester-type aliphatic peroxide, is used in combination with a diene base rubber and a co-crosslinking agent, there can be obtained from the rubber composition a hot-molded material of exceptional resilience. we have also found that golf balls composed at least in part of such a hot-molded material are capable of exhibiting an exceptional rebound.

Accordingly, the invention provides the following golf balls.

[1] A golf ball composed of a material molded under heat from a rubber composition containing (a) a diene base rubber, (b) an α,β-unsaturated carboxylic acid and/or a metal salt thereof, and (c) an organic peroxide, wherein the organic peroxide (c) includes an aliphatic peroxyester.

[2] The golf ball of [1], wherein the rubber composition contains at least 2 parts by weight of the organic peroxide per 100 parts by weight of the diene base rubber.

[3] The golf ball of [1], wherein the rubber composition additionally comprises (d) an organosulfur compound and/or (e) an inorganic filler.

[4] The golf ball of [1], wherein the α,β-unsaturated carboxylic acid is acrylic acid or methacrylic acid.

[5] The golf ball of [1], wherein the diene base rubber includes a polybutadiene having a stress relaxation time ($T_{80}$), defined as the length of time from the moment when rotor rotation is stopped immediately after measurement of the $ML_{1+4}$ (100° C.) value (the Mooney viscosity measured at 100° C. in accordance with ASTM D-1646-96) that is required for the $ML_{1+4}$ value to decrease 80%, of at most 4 seconds.

[6] The golf ball of [5], wherein the polybutadiene having a stress relaxation time ($T_{80}$) of at most 4 seconds is a polybutadiene prepared by polymerization using a rare-earth catalyst.

DETAILED DESCRIPTION OF THE INVENTION

The invention is described more fully below. The golf ball of the invention is a golf ball composed of a material molded under heat from a rubber composition which includes the following components (a) to (c):

(a) a diene base rubber, (b) an α,β-unsaturated carboxylic acid and/or a metal salt thereof, and (c) an organic peroxide which includes an aliphatic peroxyester.

As used herein, "diene base rubber" refers to a base rubber composed primarily of a diene rubber (e.g., polybutadiene rubber (BR), styrene-butadiene rubber (SBR), natural rubber, polyisoprene rubber, ethylene-propylene-diene rubber (EPDM)). The proportion of the base rubber accounted for by the diene rubber is at least 50 wt %, preferably at least 60 wt %, more preferably at least 80 wt %, and may even be 100 wt %.

To achieve a good rebound, it is preferable for component (a) to include a polybutadiene having a stress relaxation time ($T_{80}$), defined as the length of time from the moment when rotor rotation is stopped immediately after measurement of the $ML_{1+4}$ (100° C.) value (the Mooney viscosity measured at 100° C. in accordance with ASTM D-1646-96) that is required for the $ML_{1+4}$ value to decrease 80%, of at most 4 seconds.

The above indicator ($T_{80}$) is described in section 13.1.3.1 of ASTM D1646-96.

The term "Mooney viscosity" used herein refers to an industrial indicator of viscosity as measured with a Mooney viscometer, which is a type of rotary plastometer. The unit symbol used is $ML_{1+4}$ (100° C.), where "M" stands for Mooney viscosity, "L" stands for large rotor (L-type), "1+4" stands for a pre-heating time of 1 minute and a rotor rotation time of 4 minutes, and "100° C." indicates that measurement was carried out at a temperature of 100° C.

In the practice of the invention, it is desirable for above component (a) to include a polybutadiene (BR1) having a stress relaxation time ($T_{80}$) of at most 4 seconds. However, the $T_{80}$ value is preferably 3.5 seconds or less, and more preferably 3 seconds or less. The lower limit of the $T_{80}$ value is preferably 1 second or more, and most preferably 1.5 seconds or more. At a $T_{80}$ value of more than 4 seconds, the rebound decreases. On the other hand, if the $T_{80}$ value is too small, problems may arise with workability.

The polybutadiene BR1 has a Mooney viscosity ($ML_{1+4}$ (100° C.)) which, while not subject to any particular limitation, is preferably at least 20 but not more than 80.

It is recommended that the polybutadiene BR1 have a cis-1,4 bond content of at least 60%, preferably at least 80%, more preferably at least 90%, and most preferably at least 95%, and a 1,2-vinyl bond content of at most 3%, preferably at most 2%, more preferably at most 1.5%, and most preferably at most 1.3%. At a cis-1,4 bond content or a 1,2-vinyl bond content outside of these ranges, the rebound may decrease.

From the standpoint of rebound, it is preferable for the polybutadiene BR1 in the invention to be a polybutadiene synthesized using a rare-earth catalyst.

A known rare-earth catalyst may be used for this purpose. Exemplary rare-earth catalysts include those made up of a combination of a lanthanide series rare-earth compound, an organoaluminum compound, an alumoxane, a halogen-bearing compound, and an optional Lewis base.

Examples of suitable lanthanide series rare-earth compounds include halides, carboxylates, alcoholates, thioalcoholates and amides of atomic number 57 to 71 metals.

Organoaluminum compounds that may be used include those of the formula $AlR^1R^2R^3$ (wherein $R^1$, $R^2$ and $R^3$ are each independently a hydrogen or a hydrocarbon group of 1 to 8 carbons).

Preferred alumoxanes include compounds of the structures shown in formulas (I) and (II) below. The alumoxane association complexes described in *Fine Chemical* 23, No. 9, 5 (1994), *J. Am. Chem. Soc.* 115, 4971 (1993), and *J. Am. Chem. Soc.* 117, 6465 (1995) are also acceptable.

(I)

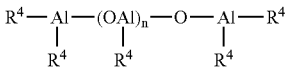

(II)

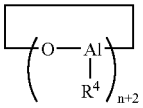

In the above formulas, $R^4$ is a hydrocarbon group having 1 to 20 carbon atoms, and n is 2 or a larger integer.

Examples of halogen-bearing compounds that may be used include aluminum halides of the formula $AlX_nR_{3-n}$ (wherein X is a halogen; R is a hydrocarbon group of 1 to 20 carbons, such as an alkyl, aryl or aralkyl; and n is 1, 1.5, 2 or 3); strontium halides such as $Me_3SrCl$, $Me_2SrCl_2$, $MeSrHCl_2$ and $MeSrCl_3$; and other metal halides-such as silicon tetrachloride, tin tetrachloride and titanium tetrachloride.

The Lewis base may be used to form a complex with the lanthanide series rare-earth compound. Illustrative examples include acetylacetone and ketone alcohols.

In the practice of the invention, the use of a neodymium catalyst in which a neodymium compound serves as the lanthanide series rare-earth compound is particularly advantageous because it enables a polybutadiene rubber having a high cis-1,4 bond content and a low 1,2-vinyl bond content to be obtained at an excellent polymerization activity. Preferred examples of such rare-earth catalysts include those mentioned in JP-A 11-35633.

The polymerization of butadiene in the presence of a rare-earth catalyst may be carried out by bulk polymerization or vapor phase polymerization, either with or without the use of solvent, and at a polymerization temperature in a range of generally from −30 to +150° C., and preferably from 10 to 100° C.

To manufacture golf balls having a stable quality, it is desirable for the above-described polybutadiene BR1 in the present invention to be a terminal-modified polybutadiene obtained by polymerization using the above-described rare-earth catalyst, followed by the reaction of a terminal modifier with active end groups on the polymer.

A known terminal modifier may be used for this purpose. Illustrative examples include compounds of types (1) to (6) below:

(1) halogenated organometallic compounds, halogenated metallic compounds and organometallic compounds of the general formulas $R^5_nM'X_{4-n}$, $M'X_4$, $M'X_3$, $R^5_nM'(—R^6—COOR^7)_{4-n}$ or $R^5_nM'(—R^6—COR^7)_{4-n}$ (wherein $R^5$ and $R^6$ are each independently a hydrocarbon group of 1 to 20 carbons; $R^7$ is a hydrocarbon group of 1 to 20 carbons which may contain pendant carbonyl or ester groups; M' is a tin, silicon, germanium or phosphorus atom; X is a halogen atom; and n is an integer from 0 to 3);

(2) heterocumulene compounds having on the molecule a Y═C═Z linkage (wherein Y is a carbon, oxygen, nitrogen or sulfur atom; and Z is an oxygen, nitrogen or sulfur atom);

(3) three-membered heterocyclic compounds containing on the molecule the following bonds

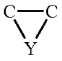

(wherein Y is an oxygen, nitrogen or sulfur atom);

(4) halogenated isocyano compounds;

(5) carboxylic acids, acid halides, ester compounds, carbonate compounds and acid anhydrides of the formula $R^8—(COOH)_m$, $R^9(COX)_m$, $R^{10}—(COO—R^{11})$, $R^{12}—OCOO—R^{13}$, $R^{14}—(COOCO—R^{15})_m$ or

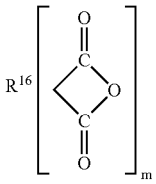

(wherein $R^8$ to $R^{16}$ are each independently a hydrocarbon group of 1 to 50 carbons, X is a halogen atom, and m is an integer from 1 to 5); and (6) carboxylic acid metal salts of the formula $R^{17}_{l}M''(OCOR^{18})_{4-l}$, $R^{19}_{l}M''(OCO—R^{20}—COOR^{21})_{4-l}$ or

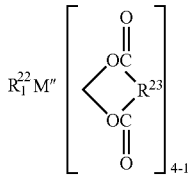

(wherein $R^{17}$ to $R^{23}$ are each independently a hydrocarbon group of 1 to 20 carbons, M" is a tin, silicon or germanium atom, and the letter l is an integer from 0 to 3).

Specific examples of the above terminal modifiers (1) to (6) and methods for their reaction are described in, for example, JP-A 11-35633 and JP-A 7-268132.

In the practice of the invention, the above-described polybutadiene BR1 is preferably included within the diene base rubber and accounts for preferably at least 40 wt %, more preferably at least 50 wt %, even more preferably at least 60 wt %, and up to 100 wt %, of the base rubber. If this proportion is too low, the rebound may decrease.

No particular limitation is imposed on rubber compounds other than BR1 (compounding rubbers) which may be included in the diene base rubber. For example, polybutadiene rubbers having a stress relaxation time $T_{80}$ of more than 4 seconds may be included, as can also other rubber compounds such as styrene-butadiene rubbers (SBR), natural rubbers, polyisoprene rubbers and ethylene-propylene-diene rubbers (EPDM). These may be used individually or as combinations of two or more.

The Mooney viscosity of such compounding rubbers included in the diene base rubber, while not subject to any particular limitation, is typically at least 20 but not more than 80.

Rubbers synthesized with a group VIII catalyst may be used as such compounding rubbers included in the diene base rubber. Exemplary group VIII catalysts include the following nickel catalysts and cobalt catalysts.

Examples of suitable nickel catalysts include single-component systems such as nickel-kieselguhr, binary systems such as Raney nickel/titanium tetrachloride, and ternary systems such as nickel compound/organometallic compound/boron trifluoride etherate. Exemplary nickel compounds include reduced nickel on a carrier, Raney nickel, nickel oxide, nickel carboxylate and organonickel complex salts. Exemplary organometallic compounds include trialkylaluminum compounds such as triethylaluminum, tri-n-propylaluminum, triisobutylaluminum and tri-n-hexylaluminum; alkyllithium compounds such as n-butyllithium, sec-butyllithium, tert-butyllithium and 1,4-dilithiumbutane; and dialkylzinc compounds such as diethylzinc and dibutylzinc.

Examples of suitable cobalt catalysts include cobalt and cobalt compounds such as Raney cobalt, cobalt chloride, cobalt bromide, cobalt iodide, cobalt oxide, cobalt sulfate, cobalt carbonate, cobalt phosphate, cobalt phthalate, cobalt carbonyl, cobalt acetylacetonate, cobalt diethyldithiocarbamate, cobalt anilinium nitrite and cobalt dinitrosyl chloride. It is particularly advantageous to use these compounds in combination with, for example, a dialkylaluminum monochloride such as diethylaluminum monochloride or diisobutylaluminum monochloride; a trialkylaluminum such as triethylaluminum, tri-n-propylaluminum, triisobutylaluminum or tri-n-hexylaluminum; an alkylaluminum sesquichloride such as ethylaluminum sesquichloride; or aluminum chloride.

Polymerization using the above group VIII catalysts, and particularly a nickel or cobalt catalyst, can be carried out by a process in which the catalyst typically is continuously charged into a reactor together with a solvent and butadiene monomer, and the reaction conditions are suitably selected, such as a reaction temperature in a range of 5 to 60° C. and a reaction pressure in a range of atmospheric pressure to 70 plus atmospheres, so as to yield a product having the above-indicated Mooney viscosity.

Component (b) may be an α,β-unsaturated carboxylic acid, specific examples of which include acrylic acid, methacrylic acid, maleic acid and fumaric acid. Acrylic acid and methacrylic acid are especially preferred. Alternatively, it may be the metal salt of an α,β-unsaturated carboxylic acid, examples of which include the zinc and magnesium salts of unsaturated fatty acids such as zinc methacrylate and zinc acrylate. The use of zinc acrylate is especially preferred.

It is recommended that the content of component (b) per 100 parts by weight of the base rubber be at least 10 parts by weight, and preferably at least 15 parts by weight, but not more than 60 parts by weight, preferably not more than 50 parts by weight, even more preferably not more than 45 parts by weight, and most preferably not more than 40 parts by weight. Too much component (b) will make the material molded under heat from the rubber composition too hard, giving the golf ball an unpleasant feel on impact. On the other hand, too little will result in a lower rebound.

Component (c) includes an aliphatic peroxide which lacks an aromatic ring in the chemical formula and which has, at the site of an ester linkage, an oxygen-oxygen bond capable of incurring radical cleavage under an external stimulus such as heat or light (i.e., a peroxide of the structural formula $R^a—C(=O)O—O—R^b$, where $R^a$ and $R^b$ are aliphatic alkyls without an aromatic ring); that is, an aliphatic peroxyester.

Illustrative examples of such aliphatic peroxyesters include 1,1,3,3-tetramethylbutyl peroxyneodecanoate, t-hexyl peroxyneodecanoate, t-butyl peroxyneodecanoate, t-butyl peroxyneoheptanoate, t-hexyl peroxypivalate, t-butyl peroxypivalate, 1,1,3,3-tetramethylbutyl peroxy-2-ethylhexanoate, 2,5-dimethyl-2,5-di(2-ethylhexanoylperoxy)hexane, t-hexyl peroxy-2-ethylhexanoate, t-butyl peroxy-2-ethylhexanoate, t-hexyl peroxy isopropyl monocarbonate, t-butyl peroxy maleic acid, t-butyl peroxy-3,5,5-trimethylhexanoate, t-butyl peroxylaurate, t-butyl peroxy isopropyl monocarbonate, t-butyl peroxy-2-ethylhexyl monocarbonate and t-butyl peroxyacetate. These may be used singly or as combinations of two or more thereof.

Of the above, the use of one or more selected from the group consisting of t-butyl peroxyacetate, t-butyl peroxylaurate and t-butyl peroxy-2-ethylhexanoate is especially preferred for increasing the rebound.

Illustrative examples of commercial products that may be used as the aliphatic peroxyester include Perocta ND, Perocta ND-50E, Perhexyl ND, Perhexyl ND-50E, Perbutyl ND, Perbutyl ND-50E, Perbutyl NHP, Perhexyl PV, Perhexyl PV-50E, Perbutyl PV, Perbutyl PV-40E, Perocta O, Perhexa 250, Perhexyl O, Percure HO(N), Perbutyl O, Percure O, Perhexyl I, Perbutyl MA, Perbutyl 355, Perbutyl L, Perbutyl I-75, Perbutyl E and Perbutyl A (all products of NOF Corporation).

No particular limitation is imposed on other organic peroxides that may be used together with the aliphatic peroxyester. Exemplary organic peroxides suitable for this purpose are aromatic peroxyesters, dialkyl peroxides, peroxyketals, diacyl peroxides, hydroperoxides, peroxydicarbonates and ketone peroxides.

Specific examples include dicumyl peroxide, di-t-butyl peroxide, 2,5-dimethyl-2,5-di-(t-butylperoxy)hexane, 2,2-bis(t-butylperoxy)butane, t-butylperoxybenzoate, benzoyl peroxide, 2,5-dimethyl-2,5-di-(2-ethylhexanoylperoxy)hexane, 1,1-di(t-butylperoxy)cyclohexane and 1,1-bis(t-butylperoxy)-3,3,5-trimethylcyclohexane. These may be used singly or as combinations of two or more thereof.

The amount of component (c) (when two or more are used, the total amount thereof) per 100 parts by weight of the base rubber is generally at least 2 parts by weight, and preferably at least 3 parts by weight, but generally not more than 30 parts by weight, and preferably not more than 20 parts by weight. Too much or too little component (c) may make it impossible to obtain a suitable hardness distribution, resulting in a poor feel, durability and rebound.

The proportion of component (c) accounted for by the above-described aliphatic peroxyester is generally at least 50 wt %, preferably at least 60 wt %, and more preferably at least 80 wt %, and may even be 100 wt %.

To further improve rebound, it is advantageous for the rubber composition in the invention to include also the following component (d) and/or component (e):

(d) an organosulfur compound;

(e) an inorganic filler.

Examples of compound (d) include thiophenols, thionaphthols, halogenated thiophenols, and metal salts thereof. Specific examples include the zinc salts of pentachlorothiophenol, pentafluorothiophenol, pentabromothiophenol, p-chlorothiophenol and pentachlorothiophenol; and diphenylpolysulfides, dibenzylpolysulfides, dibenzoylpolysulfides, dibenzothiazoylpolysulfides and dithiobenzoylpolysulfides having 2 to 4 sulfurs. These may be used singly or as combinations of two or more thereof. Diphenyldisulfide and the zinc salt of pentachlorothiophenol are especially preferred.

The amount of component (d) included per 100 parts by weight of the base rubber is preferably at least 0.1 part by weight, more preferably at least 0.2 part by weight, and even more preferably at least 0.5 part by weight, but preferably not more than 5 parts by weight, more preferably not more than 4 parts by weight, and even more preferably not more than 3 parts by weight. Too much organosulfur compound may make the material molded under heat from the rubber composition too soft, whereas too little may make an improved rebound difficult to achieve.

Examples of component (e) include zinc oxide, barium sulfate and calcium carbonate. The amount of component (e) included per 100 parts by weight of the base rubber is preferably at least 5 parts by weight, more preferably at least 7 parts by weight, even more preferably at least 10 parts by weight, and most preferably at least 13 parts by weight, but preferably not more than 80 parts by weight, more preferably not more than 50 parts by weight, even more preferably not more than 45 parts by weight, and most preferably not more than 40 parts by weight. Too much or too little inorganic filler may make it impossible to obtain a proper golf ball weight and a suitable rebound.

To increase the rebound, it is desirable for the inorganic filler to include zinc oxide in a proportion of at least 50 wt %, preferably at least 75 wt %, and most preferably 100 wt % (in which case the zinc oxide accounts for 100% of the inorganic filler).

The zinc oxide has an average particle size (by air permeametry) of preferably at least 0.01 μm, more preferably at least 0.05 μm, and most preferably at least 0.1 μm, but preferably not more than 2 μm, and more preferably not more than 1 μm.

The rubber composition in the invention may additionally include other additives; such as an antioxidant.

Examples of suitable antioxidants include 2,2'-methylenebis(4-methyl-6-t-butylphenol) (available as the commercial product Nocrac NS-6 from Ouchi Shinko Chemical Industry Co., Ltd.) and 2,2'-methylenebis(4-ethyl-6-t-butylphenol) (available as Nocrac NS-30 from Ouchi Shinko Chemical Industry Co., Ltd.). To achieve a good rebound and durability, it is recommended that the amount of antioxidant included per 100 parts by weight of the base rubber be more than 0 part by weight, preferably at least 0.05 part by weight, more preferably at least 0.1 part by weight, and most preferably at least 0.2 part by weight, but not more than 3 parts by weight, preferably not more than 2 parts by weight, more preferably not more than 1 part by weight, and most preferably not more than 0.5 part by weight.

The material molded under heat from the rubber composition in the present invention may be obtained by vulcanizing and curing the above-described rubber composition using the same type of method as is employed on prior-art rubber compositions for golf balls. Vulcanization may be carried, for example, at a temperature of from 100 to 200° C. for a period of 10 to 40 minutes.

It is recommended that the material molded under heat from the rubber composition in the invention have a hardness difference, obtained by subtracting the JIS-C hardness at the center of the hot-molded material from the JIS-C hardness at the surface of the material, of at least 15, preferably at least 16, more preferably at least 17, and even more preferably at least 18, but not more than 50, and preferably not more than 40. Setting the hardness within this range is desirable for achieving a golf ball having a soft feel and a good rebound and durability.

It is recommended that the hot-molded material obtained from the rubber composition in the invention, regardless of which of the subsequently described golf balls in which it is used, have a deflection when subjected to loading from an initial load of 98 N (10 kgf) to a final load of 1275 N (130 kgf), of at least 2.0 mm, preferably at least 2.5 mm, more preferably at least 2.8 mm, and most preferably at least 3.2 mm, but not more than 6.0 mm, preferably not more than 5.5 mm, even more preferably not more than 5.0 mm, and most preferably not more than 4.5 mm. Too small a deflection may worsen the feel of the ball on impact and, particularly on long shots such as with a driver in which the ball incurs a large deformation, may subject the ball to an excessive rise in spin, shortening the distance of travel. On the other hand, a hot-molded article that is too soft deadens the feel of the golf ball when played, compromises the rebound of the ball, resulting in a shorter distance, and gives the ball a poor durability to cracking with repeated impact.

The golf ball of the invention is composed, at least in part, of the above-described hot-molded material, but the construction of the ball is not subject to any particular limitation. Examples of suitable golf ball constructions include one-piece golf balls in which the hot-molded material serves directly as the golf ball, solid two-piece golf balls wherein the hot-molded material serves as a solid core on the surface of which a cover has been formed, solid multi-piece golf balls made of three or more pieces in which the hot-molded material serves as a solid core over which a cover composed of two or more layers has been formed, thread-wound golf balls in which the hot-molded material serves as the center core, and multi-piece golf balls in which the hot-molded material serves as an intermediate layer or outermost layer that encloses a solid core. Solid two-piece golf balls and solid multi-piece golf balls in which the hot-molded material serves as a solid core are preferred because such golf ball constructions are able to exploit most effectively the characteristics of the hot-molded material.

In the practice of the invention, when the hot-molded material serves as a solid core, it is recommended that the solid core have a diameter of at least 30.0 mm, preferably at least 32.0 mm, more preferably at least 35.0 mm, and most preferably at least 37.0 mm, but not more than 41.0 mm, preferably not more than 40.5 mm, more preferably not more than 40.0 mm, and most preferably not more than 39.5 mm.

In particular, it is recommended that such the solid core in a solid two-piece golf ball have a diameter of at least 37.0 mm, preferably at least 37.5 mm, more preferably at least 38.0 mm, and most preferably at least 38.5 mm, but not more than 41.0 mm, preferably not more than 40.5 mm, and more preferably not more than 40.0 mm.

Similarly, it is recommended that such the solid core in a solid three-piece golf ball have a diameter of at least 30.0 mm, preferably at least 32.0 mm, more preferably at least 34.0 mm, and most preferably at least 35.0 mm, but not more than 40.0 mm, preferably not more than 39.5 mm, and even more preferably not more than 39.0 mm.

It is also recommended that the solid core have a specific gravity of at least 0.9, preferably at least 1.0, and more preferably at least 1.1, but not more than 1.4, preferably not more than 1.3, and more preferably not more than 1.2.

When a solid two-piece golf ball or a solid three-piece golf ball is formed using the hot-molded material in the invention as the core, use may be made of known cover and intermediate layer-forming materials. These cover and intermediate layer-forming materials may be primarily composed of, for example, a thermoplastic or thermoset polyurethane elastomer, a polyester elastomer, an ionomer resin, a polyolefin elastomer, or a mixture thereof. The use of a thermoplastic polyurethane elastomer or an ionomer resin is especially preferred. Any one or mixture of two or more thereof may be used.

When a golf ball is formed using the hot-molded material in the invention as an intermediate layer or outermost layer enclosing a solid core, use can be made of a known core-forming material and a known intermediate layer or cover-forming material.

Illustrative examples of thermoplastic polyurethane elastomers that may be used for the above purpose include commercial products in which the diisocyanate is an aliphatic or aromatic compound, such as Pandex T7298, Pandex T7295, Pandex T7890, Pandex TR3080, Pandex T8295 and Pandex T8290 (all manufactured by DIC Bayer Polymer, Ltd.). Illustrative examples of suitable commercial ionomer resins include Surlyn 6320 and Surlyn 8120 (both products of E.I. du Pont de Nemours and Co., Inc.), and Himilan 1706, Himilan 1605, Himilan 1855, Himilan 1601 and Himilan 1557 (all products of DuPont-Mitsui Polychemicals Co., Ltd.).

The cover-forming material may include also, as an optional ingredient, a polymer other than the foregoing thermoplastic elastomers. Specific examples of polymers that may be included as optional ingredients include polyamide elastomers, styrene block elastomers, hydrogenated polybutadienes and ethylene-vinyl acetate (EVA) copolymers.

The above-described solid two-piece golf balls and solid multi-piece golf balls can be manufactured by a known method. When manufacturing solid two-piece and solid multi-piece golf balls, preferred use can be made of a known method in which the above-described hot-molded material is placed as the solid core within a given injection mold, following which a predetermined technique is used to inject over the core the above-described cover-forming material in the case of a solid two-piece golf ball, or to successively inject the above-described intermediate layer-forming material and cover-forming material in the case of a solid multi-piece golf ball. In some cases, the golf ball may be produced by molding the cover-forming material under an applied pressure.

It is recommended that the intermediate layer in a solid multi-piece golf ball have a thickness of at least 0.5 mm, and preferably at least 1.0 mm, but not more than 3.0 mm, preferably not more than 2.5 mm, more preferably not more than 2.0 mm, and most preferably not more than 1.6 mm.

Moreover, in both solid two-piece golf balls and solid multi-piece golf balls, it is recommended that the cover have a thickness of at least 0.7 mm and preferably at least 1.0 mm, but not more than 3.0 mm, preferably not more than 2.5 mm, more preferably not more than 2.0 mm, and most preferably not more than 1.6 mm.

The golf ball of the invention can be manufactured for competitive use by imparting the ball with a diameter and weight which conform with the Rules of Golf; that is, a diameter of not less than 42.67 mm and a weight of not more than 45.93 g. It is recommended that the diameter be not more than 44.0 mm, preferably not more than 43.5 mm, and most preferably not more than 43.0 mm; and that the weight be at least 44.5 g, preferably at least 45.0 g, more preferably at least 45.1 g, and most preferably at least 45.2 g.

EXAMPLES

The following Examples and Comparative Examples are provided by way of illustration and not by way of limitation.

Examples 1 to 6, Comparative Examples 1 and 2

In each example and comparative example, the starting materials shown in Table 1 below were blended in the indicated proportions within a kneader to prepare a rubber composition, which was then vulcanized at 160° C. for 20 minutes in a spherical mold, thereby giving a spherical molded material having a diameter of 31.3 mm and a weight of 19 g. The physical properties of these molded materials were evaluated. The results are shown in Table 1 below.

TABLE 1

| | Example | | | | | | Comparative Example | |
|---|---|---|---|---|---|---|---|---|
| | 1 | 2 | 3 | 4 | 5 | 6 | 1 | 2 |
| Formulation | | | | | | | | |
| BR | 100 | 100 | 100 | 100 | 100 | 100 | 100 | 100 |
| ZDA | 25 | 25 | 25 | 35 | 25 | 25 | 25 | 25 |
| ZnO | 23 | 23 | 23 | 11 | 23 | 23 | 23 | 23 |
| Antioxidant | 0.2 | 0.2 | 0.2 | 0.2 | 0.2 | 0.2 | 0.2 | 0.2 |
| PO-1 | 2 | 4 | | | 4 | 4 | | 0.5 |
| PO-2 | | | 10 | | | | | |
| PO-3 | | | | 11 | | | | |
| PO-4 | | | | | 0.2 | | 1 | |
| Zn PCTP | | | | | | 0.2 | | |
| Results | | | | | | | | |
| Core load hardness | 4.3 | 3.8 | 4.0 | 4.4 | 3.6 | 3.9 | 4.0 | 5.6 |
| Core initial velocity index | 1.001 | 1.005 | 1.002 | 1.003 | 1.005 | 1.005 | 1 | 0.989 |

BR: The polybutadiene EC140 produced by Firestone Polymer (polymerized with a neodymium catalyst). $T_{80}$ value: 2.3.
ZDA: Zinc acrylate, produced by Nippon Shokubai Co., Ltd.
ZnO: Zinc oxide, produced by Sakai Chemical Industry Co., Ltd.
Antioxidant: NS-6, produced by Ouchi Shinko Chemical Industry Co., Ltd.
PO-1: Produced by NOF Corporation under the trade name Perbutyl L (t-butyl peroxylaurate; purity, 98%)
PO-2: Produced by NOF Corporation under the trade name Perbutyl A (t-butyl peroxyacetate; purity, 50%)
PO-3: Produced by NOF Corporation under the trade name Perbutyl O (t-butyl peroxy-2-ethylhexanoate; purity, 97%)
PO-4: Produced by NOF Corporation under the trade name Percumyl D (dicumyl peroxide; purity, 98%)
Zn PCTP: Zinc salt of pentachlorothiophenol.

Core Load Hardness

Deflection when subjected to loading from an initial load of 98 N (10 kgf) to a final load of 1275 N (130 kgf).

Core Initial Velocity Index

The initial velocity was measured with an initial velocity measuring apparatus of the same type as that of the United States Golf Association (USGA)—the official golf ball regulating body, and was represented as a ratio based on the value obtained in Comparative Example 1.

The invention claimed is:

1. A golf ball, comprising a material molded under heat from a rubber composition comprised of (a) a diene base rubber, (b) an α,β-unsaturated carboxylic acid and/or a metal salt thereof, and (c) an organic peroxide, wherein the organic peroxide (c) includes an aliphatic peroxyester, wherein the diene base rubber (a) includes a polybutadiene having a stress relaxation time ($T_{80}$), defined as the length of time from the moment when rotor rotation is stopped immediately after measurement of the $ML_{1+4}$ (100° C.) value (the Mooney viscosity measured at 100° C. in accordance with ASTM D-1646-96) that is required for the $ML_{1+4}$ value to decrease 80%, of at most 4 seconds, and wherein the polybutadiene having a stress relaxation time ($T_{80}$) of at most 4 seconds is a polybutadiene prepared by polymerization using a rare-earth catalyst.

2. The golf ball of claim 1, wherein the rubber composition contains at least 2 parts by weight of the organic peroxide per 100 parts by weight of the diene base rubber.

3. The golf ball of claim 1, wherein the rubber composition additionally comprises (d) an organosulfur compound and/or (e) an inorganic filler.

4. The golf ball of claim 1, wherein the α,β-unsaturated carboxylic acid is acrylic acid or methacrylic acid.

5. The golf ball of claim 1, wherein the article molded under heat from the rubber composition has a hardness difference, obtained by subtracting the JIS-C hardness at the center of the hot-molded article from the JIS-C hardness at the surface of the article, of at least 15, but not more than 50.

6. The golf ball of claim 3, wherein the inorganic filler includes zinc oxide in a proportion of at least 50 wt %.

7. The golf ball of claim 6, wherein the zinc oxide of the inorganic filler has an average particle size by air permeametry of at least 0.01 μm and not more than 2 μm.

* * * * *